United States Patent [19]

Arai et al.

[11] Patent Number: 4,522,574

[45] Date of Patent: Jun. 11, 1985

[54] BALANCING WEIGHT DEVICE FOR SCROLL-TYPE FLUID MACHINE

[75] Inventors: Nobukatsu Arai; Naoki Maeda, both of Ibaraki, Japan

[73] Assignee: Hitachi, Ltd., Tokyo, Japan

[21] Appl. No.: 544,225

[22] Filed: Oct. 21, 1983

[30] Foreign Application Priority Data

Oct. 27, 1982 [JP] Japan ..... 57-187409

[51] Int. Cl.[3] ..... F01C 1/04; F01C 17/06; F01C 21/02

[52] U.S. Cl. ..... 418/55; 418/151

[58] Field of Search ..... 418/55, 151

[56] References Cited

U.S. PATENT DOCUMENTS 3,377,873 4/1968 Patterson, Jr. ..... 418/151
3,473,728 10/1969 Vulliez .
3,802,809 4/1974 Vulliez .
3,876,344 4/1975 Nestor ..... 418/151
3,884,599 5/1975 Young et al. .
3,994,636 11/1976 McCullough et al. ..... 418/55
4,406,600 9/1983 Terauchi et al. ..... 418/55

FOREIGN PATENT DOCUMENTS 57-26203 2/1982 Japan ..... 418/55

*Primary Examiner*—John J. Vrablik
*Attorney, Agent, or Firm*—Antonelli, Terry & Wands

[57] ABSTRACT

A balancing weight device for scroll-type fluid machine including a balancing weight rotatably secured to the orbital scroll member of the machine through a bearing, with the balancing weight producing a centrifugal force balancing the centrifugal force produced in the orbital scroll member during operation of the fluid machine.

13 Claims, 6 Drawing Figures

BALANCING WEIGHT DEVICE FOR SCROLL-TYPE FLUID MACHINE

BACKGROUND OF THE INVENTION

The present invention relates to a scroll-type fluid machine such as, for example, a compressor for generating high-pressure gas, compressor or expander of air conditioner refrigerator, turbine and more particularly, to a balancing weight device for use in a scroll-type fluid machine.

In scroll type fluid machines, a balancing weight is attached to the orbital scroll member of the machine, in order to obtain a force which balances the centrifugal force generated by the orbital rotary motion of the orbital scroll member during the operation of the machine. Balancing weights of the aforementioned type are described in, for example, U.S. Pat. Nos. 3,473,728; 3,802,809; 3,874,827; 3,884,599; 4,082,484; 4,325,683; 4,332,535; 4,340,339; 4,129,405; 4,192,152; and 4,199,308. A disadvantage of the proposed balancing weights resides in the fact that the balancing weight is integrally connected to the driving shaft for orbitally driving the orbital scroll member.

During the operation, the centrifugal force generated on the orbital scroll member is transmitted to the drive shaft through a bearing interposed between the orbital scroll member and the drive shaft, so as to balance the counter or balancing centrifugal force which is generated by the balancing weight integrally connected to the drive shaft. Thus, the centrifugal force generated on the orbital scroll member balances through the bearing with the balancing force generated by balancing weight. Therefore, a load of the same level as the centrifugal force is applied to the bearing interposed between the orbital scroll member and the drive shaft and also to the bearing which supports the drive shaft. Consequently, these bearings are worn down due to the heavy load in quite a short period of time so that the radius of the orbital movement of the orbital scroll member is undesirably increased beyond the preselected value.

Accordingly, it is a primary object of the invention to provide a scroll type fluid machine which can maintain the radius of orbital movement of the orbital scroll member within a preselected value.

It is another object of the invention to provide a scroll type fluid machine in which the bearing interposed between the orbital scroll member and the drive shaft, as well as at least one bearing supporting the drive shaft, are substantially freed from the centrifugal force generated on the orbital scroll member.

It is still another object of the invention to provide a scroll type fluid machine equipped with a balancing weight and, hence, suited to high-speed operation.

It is a further object of the invention to provide a scroll type fluid machine equipped with a balancing weight and suited to systems of large capacities.

To these ends, according to the invention, there is provided a scroll type fluid machine in which a balancing weight is attached to the orbital scroll member through a bearing such that the balance weight rotates in synchronism with the rotation of a crankshaft which engages with the orbital scroll member through another bearing.

The above and other objects, features and advantages of the invention will become clear from the following description of the preferred embodiments taken in conjunction with the accompanying drawings.

DETAILED DESCRIPTION

Figure 1:
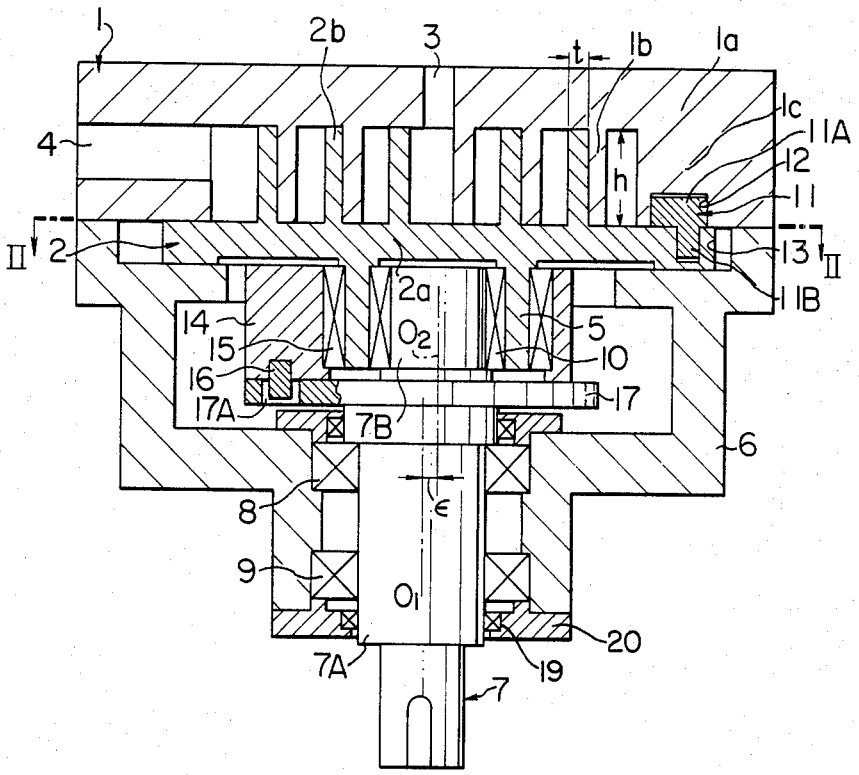
FIG. 1 is a vertical cross sectional view of an embodiment of the invention.
Figure 2:
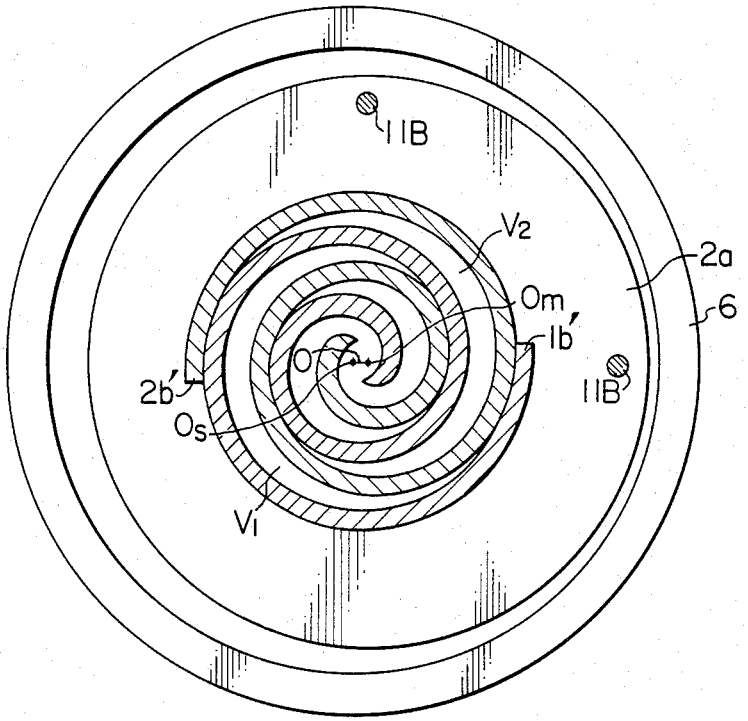
FIG. 2 is a cross sectional view taken along the line II—II of FIG. 1.
Figure 3:
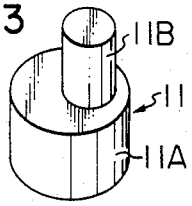
FIG. 3 is a perspective view of a rotation prevention means.

Referring now to the drawings wherein like reference numerals are used throughout the various views to designate like parts and, more particularly, to FIGS. 1 to 4, according to these figures, an open-type compressor includes a compression mechanism including a stationary scroll member generally designated by the reference numeral 1 and an orbital scroll member generally designated by the reference numeral 2 with the stationary scroll member 1 having an end member 1*a*, a spiral wrap 1*b* formed to protrude from one surface of the end member 1*a*. The spiral wrap 1*b* has a thickness t with a height h, and an annular portion 1*c* formed around the wrap 1*b*, having the same height as the wrap 1*b*. A high-pressure port 3 and a low-pressure port 4 are formed in the central portion and the annular portion of the stationary scroll member 1, respectively. On the other hand, the orbital scroll member 2 has an end plate 2*a* and a spiral wrap 2*b* formed to protrude from one side of the end plate 2*a* and having a thickness t and a height h. The orbital scroll member 2 is provided with a cylindrical boss 5 formed on the other side of the end plate 2*a* thereof, with the boss 5 being formed as a unit with the end plate 2*a*. This, however, is not exclusive and the cylindrical boss 5 may be constituted by a cylindrical piece which is formed separately from the end plate 2*a* and fixed to the latter by welding or by means of bolts.

The stationary scroll member 1 and the orbital scroll member 2 are disposed in opposition to each other with the wraps 1*b* and 2*b* meshing with each other in such a manner that the radially outer ends 1*b*′ and 2*b*′ of these wraps 1*b* and 2*b* are positioned in symmetry with each other with respect to the center point O which is located on a line connecting the centers Os and Om of the stationary scroll member 1*a* and the orbital scroll member and spaced equally from these centers Os and Om. A frame 6 is secured to the annular portion 1*c* of the stationary scroll member 1 by means of bolts.

A crankshaft generally designated by the reference numeral 7 includes a main shaft portion 7A and an eccentric shaft portion 7B, with an axis $O_2$ of the eccentric shaft portion 7B being located at a position spaced from the axis $O_1$ of the main shaft portion 7A by a distance $\epsilon$ which is slightly smaller than the radius $\epsilon_0$ orbital movement determined by both scroll members 1 and 2.

The crankshaft 7 is supported at its main shaft portion 7A by the frame 6 through bearings 8 and 9. In this state, the axis $O_1$ of the main shaft portion 7A coincides with the center $O_S$ of the stationary scroll member 1.

The eccentric shaft portion 7B of the crankshaft 7 is received by the bore in the boss 5 of the orbital scroll member 2. An orbital bearing 10 is interposed between the eccentric shaft portion 7B and the boss 5.

A rotation prevention means generally designated by the reference numeral 11 is interposed between the annular portion 1c of the stationary scroll member 1 and the end plate 2a of the orbital scroll member 2, with the rotation prevention means 11 serving to prevent the orbital scroll member 2 from rotating around the eccentric shaft portion 7B during the orbital movement of the same. More specifically, the rotation prevention means 11 is composed of a circular disc portion 11A and a columnar pin portion 11B. The pin portion 11B has an axis spaced from the center of the disc portion 11A by a distance which is equal to the aforementioned radius $\epsilon$ of orbital movement. The disc portion 11A is received by a circular hole 12 formed in the annular portion 1c, while the pin portion 11B is received by a circular hole 13 formed in the end plate 2a, respectively. In addition, the disc portion 11A is rotatable relatively to the annular portion 1c while the pin portion 11B is rotatable relatively to the end plate 2a.

Usually, two, three or more rotation prevention means 11 are incorporated. When two rotation prevention means 11 are used, they are arranged at 90° or 270° interval, whereas, when three or more are used, they are arranged at an equal angular interval.

A balancing weight 14 is secured to the outer periphery of the boss 5 of the orbital scroll member 2 through the medium of the bearing 15. The balance weight 14 has a key 16 which fits in a keyway 17A formed in a disc 17 coupled to the crankshaft 7. The key 16 is allowed to move in the radial direction along the keyway 17A. Namely, the key 16 is adapted to transmit only the rotation from the crank shaft 7 to the balancing weight 14 without restricting radial movement of the balancing weight 14 so that the balancing weight 14 makes a rotation at the same speed as the crankshaft 7. On the other hand, the balancing weight 14 is offset in the direction opposite to the direction of eccentricity of the eccentric shaft portion 7B of the crankshaft 7 so that the balancing weight 14 produces, when it is rotated, a centrifugal force which acts in the opposite direction to that produced by the orbital scroll member 2, and the mass of the balancing weight 14 is so determined that the magnitude of the centrifugal force produced by the balancing weight 14 is substantially equal to the centrifugal force produced by the orbital scroll member 2.

Figure 4:
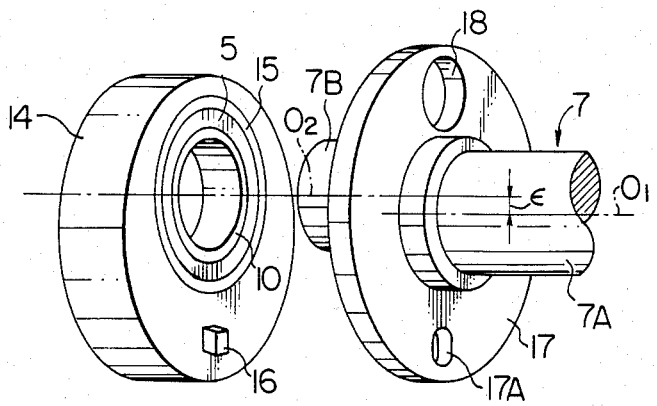
FIG. 4 is an exploded perspective view of a portion of the present invention

An explanation will be made hereinafter as to the relationship between the key 16 of the balancing weight 14 and the keyway 17A formed in the disc 17 secured to the crankshaft 7. As shown in FIG. 4, the radial size of the keyway 17A is greater than the radial length of the key 16 so that the key 16 is allowed to move radially in the keyway 17A over a suitable radial length. On the other hand, the disc 17 has a hole 18 which serves as a negative mass for attaining a balance between the centrifugal force produced by the eccentric shaft portion 7B and the negative centrifugal force produced by the keyway 17A. Although the hole 18 in the illustrated embodiment is circular, the hole can have another suitable form.

The crankshaft is driven to rotate by a driving device (not shown) such as a motor, so that the orbital scroll member 2 makes an orbital movement while being prevented from rotating by the rotation prevention means 11. As a result of this orbital movement, a gas is drawn into the compressor through the low-pressure port 4 formed in the stationary scroll member 1 and is confined in the compression chambers $V_1$, $V_2$ which are formed by the outermost turns of the wraps 1b and 2b of the stationary and orbital scroll members 1 and 2. The compression chambers $V_1$ and $V_2$ are progressively moved towards the centers of the wraps while decreasing their volumes so that the gas is gradually compressed to a high pressure. The gas of the high pressure is then discharged to the outside of the compressor through the high-pressure port 3.

During the operation of the compressor, the orbital scroll member 2 undergoes both of the centrifugal force produced as a result of the orbital movement and the load produced by the pressure of the gas which is being compressed. On the other hand, the balancing weight 14, which engages through the key 16 and the keyway 17A with the disc 17 connected to the crankshaft 7 rotates together with the crankshaft 7, so as to rotate together with the crankshaft 7, to thereby produce a centrifugal force substantially equal to that of the centrifugal force produced in the orbital scroll member 2 and acting in the counter direction to that produced by the orbital scroll member 2. Consequently, the centrifugal force produced by the orbital scroll member 2 and the centrifugal force generated by the balancing weight 14 negate each other to substantially nullify the centrifugal force acting on the orbital scroll member 2. In other words, no substantial centrifugal force caused by the orbital movement of the orbital scroll member acts on the bearings 8, 9 and the orbital bearing 10. It is, therefore, possible to minimize the wear of the bearings 8, 9 and 10 which are the most influential factors for maintaining the correct orbit of the orbital movement of the orbital scroll member 2, and to realize a compact and high-speed scroll-type compressor or a scroll-type compressor having a large capacity. In addition, it is possible to use a bearing having a small load capacity, i.e. a small-sized bearing, as the orbital bearing 10 because, in this embodiment, the orbital bearing 10 is required to bear only a small load produced by the gas pressure.

In this scroll-type compressor, the orbital scroll member 2 executes an orbital movement by the crankshaft 7 having a fixed eccentricity. Since the eccentricity is fixed, the undesirable collision of the wraps 1b and 2b of both scroll members 1, 2 by externally caused vibration and, hence, damaging of these wraps 1b and 2b due to collision with each other are advantageously avoided.

Furthermore, in the scroll-type compressor of the invention, a radial play is formed between the keyway 17A and the key 16 through which the balancing weight 14 is held in engagement with the disc 17 connected to the crankshaft 7. It is, therefore, possible to prevent the centrifugal force of the balancing weight 14 from being transmitted to the crankshaft 7. Furthermore, the vibration caused by the rotation of the crankshaft 7 is minimized because of the presence of the hole 18 which eliminates the unbalance of the rotating mass of the crankshaft 7. This also contributes to the realization of compact and high-speed scroll-type compressor or scroll-type compressor having a large capacity.

The centrifugal force Fcm generated in the orbital scroll member 2 is given by the following formula:

$$Fcm = M\epsilon\omega^2$$

where, M represents the mass of the orbital scroll member 2, $\epsilon$ represents the amount of eccentricity of the eccentric shaft portion 7B and $\omega$ represents the angular velocity of rotation. Thus, the centrifugal force Fcm is a rotational speed, more strictly in proportion to the square of the angular velocity $\omega$. The centrifugal force Fcm is also increased in accordance with the increase in the capacity, i.e. in accordance with the increase in the mass M, because the volume of the orbital scroll member 2 is changed substantially in proportion to the cube of the capacity. According to the invention, however, since the obtital bearing 10 and bearings 8 and 9 are freed from the centrifugal force Fcm, it is possible to reduce the wear of these bearings and to enhance the reliability. In addition, since the distance between the orbital bearing 10 and the crankshaft 7 can be decreased, it is possible to decrease the moment which is attributable to the deviation of the point of application of the force generated by the gas pressure and the point of support of the shaft. Consequently, the load applied to the bearing can advantageously decreased. An oil seal 19 is retained by a seal retainer 20, with the oil seal 19 effectively preventing a grease filling the bearings 8 and 9 as a lubricant from coming outside.

In the above described scroll-type compressor the pressure of the gas confined in the compression chambers $V_1$ and $V_2$ produces an axial force which acts to move the orbital scroll member 2 axially away from the stationary scroll member 1. This axial thrust force acting on the orbital scroll member 2 is carried by the frame 6. However, it is possible to negate this axial thrust force by introducing the gas under compression from the compression chambers $V_1$ and $V_2$ to the back side, i.e. the side opposite to the stationary scroll member 1, of the orbital scroll member 2. Such a means for supporting the orbital scroll member is disclosed in, for example, U.S. Pat. Nos. 4,365,941 and 4,343,599, as well as in commonly assigned U.S. patent application Ser. No. 139,548, filed on Apr. 11, 1980. This mean can suitably be combined with the device of the invention.

Figure 5:
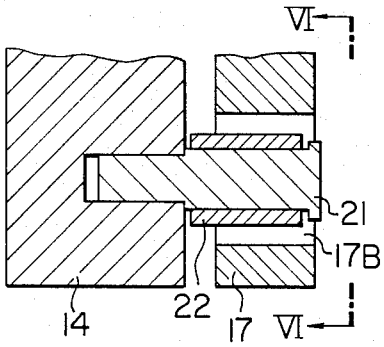
FIG. 5 is a cross sectional view of a portion of another embodiment, taken along the line V—V of FIG. 6.
Figure 6:
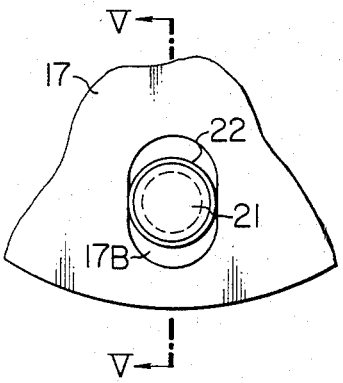
FIG. 6 is a cross sectional view taken along the line VI—VI of FIG. 5.

In FIGS. 5 and 6 the balancing weight 14 engages with the disc 17 connected to the crankshaft 7, by a different way from that in the first embodiment. Namely, in the embodiment of FIGS. 5 and 6, a pin 21 is press-fitted at its one end to the balancing weight 14. A sleeve 22, having a surface hardened by a suitable treatment such as high-frequency quenching, carburizing, nitriding or the like, is rotatably fitted around the other end of the pin 21. The pin 21 together with the sleeve 22 is received by an oval pin-receiving bore 17B formed in the disc 17, to thereby operatively connect the balancing weight 14 to the disc 17. According to the embodiment of FIGS. 5 and 6, it is possible to eliminate any unfavorable effect which may be caused during the operation of the compressor by a bearing clearance or the slight offset due to wear in the bearing 15.

Although the invention has been described as being applied to a scroll-type compressor, it will be clear to those skilled in the art that the same effect or advantage can be obtained when the invention is applied to other machines than the described compressor, such as an expander, pump or the like.

What is claimed is:

1. A scroll-type fluid machine comprising a stationary scroll member provided with a spiral wrap of predetermined thickness and height, an orbital scroll member provided with a spiral wrap of predetermined thickness and height and a boss having a bore therein, said scroll members being assembled together with the spiral wraps thereof meshing with each other, a crankshaft having an eccentric shaft portion, bearing means for enabling an engagement between the eccentric shaft portion and said orbital scroll member, rotation prevention means for fluid machine according to claim 1, wherein said balancing weight means has a centroid which is located at a opposite side of an axis of rotation of said crankshaft to the direction of eccentricity of the eccentric portion of said crankshaft. preventing rotation of said orbital scroll member around its own axis so that said orbital scroll member performs an orbital movement with rotating around its own axis while being driven by said crankshaft, a balancing weight means for producing a centrifugal force acting in a direction opposite to a direction of the centrifugal force produced in said orbital scroll member, a bearing means for rotatably securing the balance weight to said orbital scroll member, whereby the balancing weight means is rotatably mounted on an outer periphery of the boss of the orbital scroll member so that the balancing weight is rotated synchronously with the crankshaft, and a torque transmitting means for transmitting with no radial motion only the torque of said crankshaft to said balancing weight means such that said balancing weight means rotates in the same direction and at the same speed as the rotation of said crankshaft.

2. A scroll-type fluid machine according to claim 1, wherein said balancing weight means has a centroid which is located at a opposite side of an axis of rotation of said crankshaft to the direction of eccentricity of the eccentric portion of said crankshaft.

3. A scroll-type fluid machine according to claim 1, wherein the boss is formed on a side of the orbital scroll member opposite the spiral wrap.

4. A scroll-type fluid machine having a stationary scroll member provided with a spiral wrap of a predetermined thickness and height, an orbital scroll member provided with a spiral wrap of a predetermined thickness and height, said scroll members being assembled together with the spiral wraps thereof meshing with each other, a crankshaft having an eccentric shaft portion, bearing means for enabling engagement between the eccentric shaft portion and said orbital scroll member, rotation prevention means for preventing rotation of said orbital scroll member around its own axis so that said orbital scroll member performs an orbital movement without rotating around its own axis while being driven by said crankshaft, a balancing weight device for producing a centrifugal force acting in a counter direction opposite to a direction of the centrifugal force produced in the orbital scroll member, a bearing means for rotatably securing the balancing weight to said orbital scroll member, and a torque transmitting means adapted to transmit with no radial motion only the torque of said crankshaft to said balancing weight such that said balancing weight rotates in the same direction and at the same speed as the rotation of said crankshaft, said torque transmitting means includes a disc coupled to said crankshaft to rotate as a unit with said crankshaft, a keyway formed in said disc, and a key connected to said balancing weight and engaging said keyway.

5. A scroll-type fluid machine comprising a stationary scroll member provided with a spiral wrap of a predetermined thickness and height, an orbital scroll member provided with a spiral wrap of predetermined thickness and height, said scroll members being assembled together with the spiral wraps thereof meshing with each other, a crankshaft having an eccentric shaft portion, bearing means for enabling an engagement between the eccentric shaft portion and said orbital scroll member, rotation prevention means for preventing rotation of said orbital scroll member around its own axis so that said orbital scroll member performs an orbital movement without rotating around its own axis while being driven by said crankshaft, a balancing weight device for producing a centrifugal force acting in a direction opposite to a direction of the centrifugal force produced in said orbital scroll member, bearing means for rotatably securing the balancing weight to said orbital scroll member, and a torque transmitting means for transmitting with no radial motion only the torque of said crankshaft to said balancing weight such that the balancing weight rotates in the same direction and at the same speed as the rotation of said crankshaft, said torque transmitting means includes a disc coupled to said crankshaft for rotation as a unit with said crankshaft, an oval bore formed in said disc, a pin attached to said balancing weight and having a free end extending into said oval bore, and a sleeve fitting on said pin and engaging at an outer peripheral surface thereof with a wall defining said oval bore.

6. A scroll-type fluid machine comprising: a stationary scroll member having an end member, a spiral wrap protruding from said end member and having a predetermined thickness and height, and an annular portion formed around said spiral wrap; an orbital scroll member having an end plate and having a spiral wrap protruding from said end plate and having a predetermined thickness and height, said spiral wrap being held in meshing engagement with said spiral wrap of said stationary scroll member; a boss formed on a side of said end plate of said orbital scroll member opposite the spiral wrap; a frame means connected to said annular portion of said stationary scroll member; a crankshaft having a main shaft portion supported by said frame means through a bearing and an eccentric shaft portion with an axis located at a predetermined eccentricity from the axis of said main shaft portion, bearing means for enabling an engagement between said eccentric shaft portion and an inside of said boss; a rotation prevention means disposed between said end plate of said orbital scroll member and said annular portion of said stationary scroll member; a balancing weight means including a balancing weight, bearing means for rotatably mounting the balancing weight on an outer periphery of said boss so that the balancing weight is rotated synchronously with the crankshaft, said balancing weight being adapted to produce a centrifugal force which acts in a direction opposite to the centrifugal force produced in said orbital scroll member, and a torque transmitting means for transmitting with no radial motion only the torque of said crankshaft to said balancing weight.

7. A scroll-type fluid machine according to claim 6, wherein said torque transmitting means includes a disc coupled to said crankshaft, and a balance hole means formed in the disc for negating the centrifugal force produced by said eccentric shaft portion of said crankshaft.

8. A scroll-type fluid machine according to claim 6, wherein said rotation prevention means includes a circular disc and a pin provided on said disc at an offset from a center of said disc.

9. A scroll-type fluid machine comprising: a stationary scroll member having an end member, a spiral wrap protruding from said end member and having a predetermined thickness and height, and an annular portion formed around said spiral wrap; an orbital scroll member having an end plate, and a spiral wrap protruding from said end plate and having a predetermined thickness and height, said spiral wrap being held in meshing engagement with said spiral wrap of said stationary scroll member; a boss formed on a side of said end plate of said orbital scroll member opposite the spiral wrap; a frame means connected to said annular portion of said stationary scroll member; a crankshaft having a main shaft portion supported by said frame means and an eccentric shaft portion with an axis located at a predetermined eccentricity from the axis of said main shaft portion, bearing means for enabling an engagement between said eccentric shaft portion and an inside of said boss; a rotation prevention means disposed between said end plate of said orbital scroll member and said annular portion of said stationary scroll member; a balancing weight means including a balancing weight, bearing means for rotatably mounting the balancing weight on an outer periphery of said boss, said balancing weight means being adapted to produce a centrifugal force which acts in a direction opposite to the centrifugal force of said orbital scroll member, and a torque transmitting means for transmitting with no radial motion only the torque of said crankshaft to said balancing weight, said torque transmitting means includes a disc coupled to said crankshaft to rotate as a unit with said crankshaft, a keyway formed in said disc, and a key connected to said balancing weight and engaging said keyway.

10. A scroll-type fluid machine according to claim 9, wherein said torque transmitting means includes a disc coupled to said crankshaft for rotation as a unit with said crankshaft, an oval bore formed in said disc, a pin attached to said balancing weight and having a free end extending into said oval bore, and a sleeve fitting on said pin and engaging at an outer peripheral surface thereof with a wall defining said oval bore.

11. A scroll-type fluid machine according to claim 9, wherein said torque transmitting means includes a disc coupled to said crankshaft, and a balance hole means formed in the disc for negating the centrifugal force produced by said eccentric shaft portion of said crankshaft.

12. A scroll-type fluid machine according to claim 9, wherein said rotation prevention means includes a circular disc and a pin provided on said disc at an offset from a center of said disc.

13. A scroll-type fluid machine comprising: a stationary scroll member having an end member, a spiral wrap protruding from said end member and having a predetermined thickness and height, and an annular portion formed around said spiral wrap; an orbital scroll member having an end plate, and a spiral wrap protruding from said end plate and having a predetermined thickness and height, said spiral wrap being held in meshing engagement with said spiral wrap of said stationary scroll member; a boss formed on a side of said end plate of said orbital scroll member opposite the spiral wrap; a frame means connected to said annular portion of said stationary scroll member; a crankshaft having a main shaft portion supported by said frame means and an eccentric shaft portion with an axis located at a predetermined eccentricity from the axis of said main shaft portion, bearing means for enabling an engagement between said eccentric shaft portion and an inside of said boss; a rotation prevention means disposed between said end plate of said orbital scroll member and said annular portion of said stationary scroll member; a balancing weight means including a balancing weight, bearing means for rotatably mounting the balancing weight on an outer periphery of said boss, said balancing weight means being adapted to produce a centrifugal force which acts in a direction opposite to the centrifugal force of said orbital scroll member, and a torque transmitting means for transmitting with no radial motion only the torque of said crankshaft to said balancing weight, said torque transmitting means includes a disc coupled to said crankshaft for rotation as a unit with said crankshaft, an oval bore formed in said disc, a pin attached to said balancing weight and having a free end extending into said oval bore, and a sleeve fitting on said pin and engaging at an outer peripheral surface thereof with a wall defining said oval bore.

* * * * *